United States Patent [19]

Blaese

[11] Patent Number: 4,459,597

[45] Date of Patent: Jul. 10, 1984

[54] ISOLATED ANTENNA ASSEMBLY

[75] Inventor: Herbert R. Blaese, Chicago, Ill.

[73] Assignee: Orion Industries, Inc.

[21] Appl. No.: 319,472

[22] Filed: Nov. 9, 1981

[51] Int. Cl.[3] ..... H01Q 9/32

[52] U.S. Cl. ..... 343/900; 343/904; 174/5 R; 174/138 D

[58] Field of Search ..... 343/709, 710, 722, 749, 343/802, 890, 904, 906, 907, 900; 174/5 R, 85, 138 A, 138 D, 139

[56] References Cited

U.S. PATENT DOCUMENTS

| | | | |
|---|---|---|---|
| 2,068,100 | 1/1937 | Finch | 343/904 |
| 3,098,230 | 7/1963 | Nickerson et al. | 343/709 |
| 3,513,473 | 5/1970 | Seward | 343/802 |
| 4,092,646 | 5/1978 | Newington | 343/749 |
| 4,177,493 | 12/1979 | Bliamptis | 343/904 |
| 4,238,799 | 12/1980 | Parfitt | 343/749 |
| 4,238,800 | 12/1980 | Newington | 343/749 |
| 4,291,639 | 9/1981 | Burdick | 174/85 |

*Primary Examiner*—Eli Lieberman
*Assistant Examiner*—Michael C. Wimer
*Attorney, Agent, or Firm*—Dressler, Goldsmith, Shore, Sutker & Milnamow, Ltd.

[57] ABSTRACT

An isolator assembly for isolating a transmitting and receiving communications antenna member from a mast and connector. The isolator assembly electrically couples an antenna member to a connector for passage of radio frequency energy but also electrically isolates the antenna member from the connector and the mast from a high voltage on the antenna member.

8 Claims, 5 Drawing Figures

ISOLATED ANTENNA ASSEMBLY

BACKGROUND OF THE INVENTION

Long antenna assemblies, such as those typically used as home base station antennas by C.B. operators, when being erected, and occasionally in use, present safety hazards to installers and users. Contact with power lines which sometimes accidentally occurs results in serious injury and sometimes death to those in contact with the connecting cable or mast. Warnings and cautions are insufficient to assure absolute safety in use and installation.

SUMMARY OF THE INVENTION

In accordance with the present invention there is provided a communications antenna which is provided with an isolater assembly for isolating the metal radiator or antenna member from the mast and coaxial conductor. The isolator assembly allows for effective transmission of the radio frequency energy between the antenna member and the coaxial conductor, but electrically isolates the radiator from the coaxial conductor and mast up to a designed maximum breakdown voltage which is set at a level high enough effectively to insulate the installer or user from the effect of contact with power lines carrying a normally encountered voltage in environments in which CB base stations are installed and used.

A transmitting and receiving communications antenna assembly for electrically isolating a radiator from a mast and a connector in accordance with this invention comprises an elongate radiator adapted for mounting on a mast and an isolator assembly for electrically coupling the antenna member to the connector, for mounting the radiator on a mast and for electrically isolating the antenna member from the mast and the connector.

The isolator assembly comprises a radiator mount comprising a gap defining means, capacitor plate means mounted adjacent the gap defining means to confront in spaced relation to the radiator to define a capacitor therewith, and a tuning circuit means electrically connected to the capacitor plate means for connecting the capacitor plate means to the connector. The capacitor couples the radiator to the tuning circuit means to isolate the connector and a mast from a high voltage on said radiator and electrically couple radio frequency energy between the connector and the radiator.

The isolator assembly may further comprise a second capacitor plate means spaced from the first plate means to define a second capacitor with gap defining means therebetween. The radiator and first capacitor plate means define a first capacitor and the first capacitor plate means and the second capacitor plate means define a second capacitor for the two capacities coupling the radiator to said tuning circuit means. The isolator assembly may also include the tuning circuit which comprise a coil connected to the second capacitor plate to the connector and circuit means for tuning the antenna assembly and for matching the impedance of the atenna assembly to the impedance of a load, such as a coaxial cable, connected to said connector.

The circuit means includes an adjustable tuning plate mounted on the isolator assembly which define a third capacitor with the second capacitor plate means.

In its preferred form the radiator mount comprises a tubular insulating form for receiving the base of an antenna member, the first capacitor plate means is curved and is mounted on the tubular form and is spaced away from said antenna member to define a first capacitor therewith, and the second plate means is mounted to the tubular form, is displaced from the antenna member and is spaced away from the curved plate member to define a second capacitor therewith.

The second capacitor means comprises a first sleeve member confronting the curved plate means and a second sleeve member axially spaced therefrom, each electrically connected to the coil, and a tuning capacitor plate spaced from and confronting the second capacitor means to define a third capacitor which is a tuning capacitor to match the impedance of the antenna assembly to that of a cable connected to the connector.

Numerous other advantages and features of the present invention will become readily apparent from the following detailed description of the invention and of one embodiment thereof, from the claims and from the accompanying drawing in which each and every detail shown is fully and completely disclosed as a part of this specification in which like numerals refer to like parts.

Figure 1:
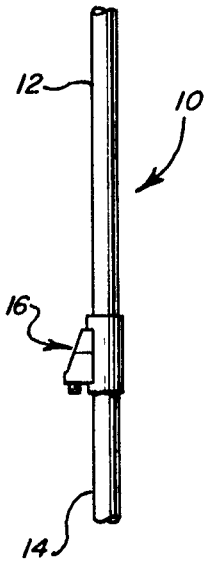
FIG. 1 is a side elevational view of an antenna assembly in accordance with this invention.
Figure 4:
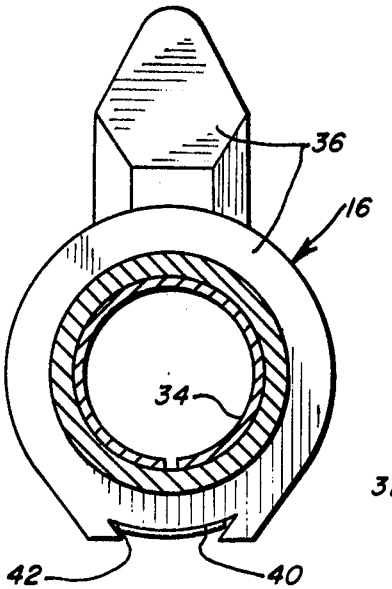
FIG. 4 is a view taken substantially along line 4—4 of FIG. 2.
Figure 2:
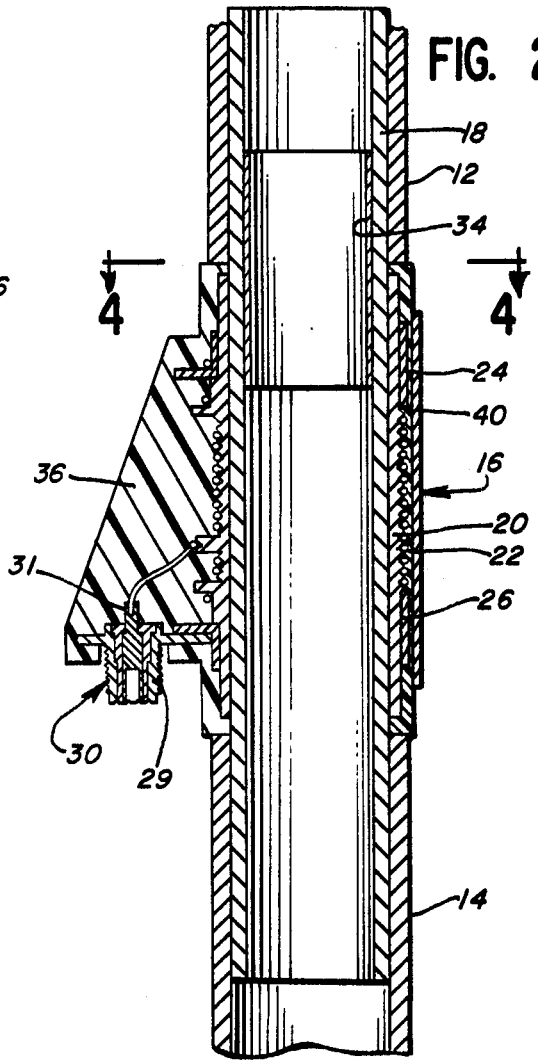
FIG. 2 is an enlarged longitudinal cross-sectional view of a portion of the assembly of FIG. 1.
Figure 3:
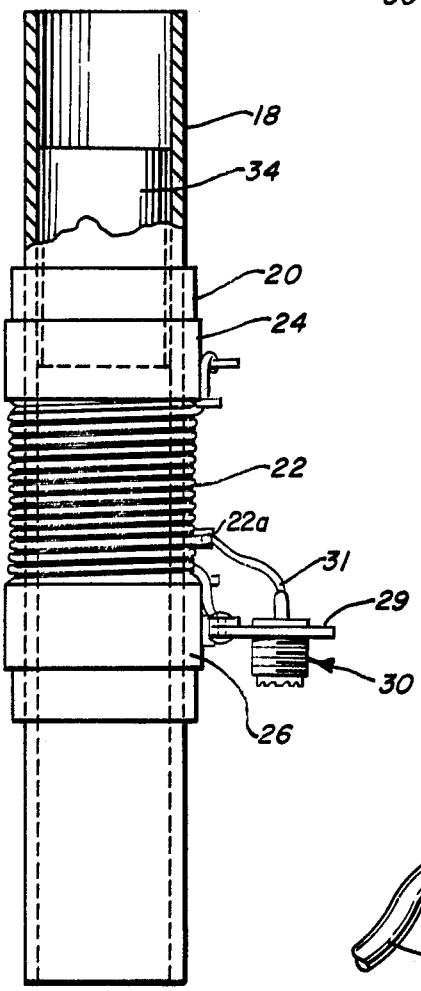
FIG. 3 is a fragmentary view of a portion of FIG. 2.

Referring now to the drawings, an antenna assembly 10 in accordance with this invention may comprise an antenna rod member or radiator 12, such as a one-half wave length radiator for citizen's band use. In accordance with this invention, radiator 12 is adapted to be mounted, in electrically isolated fashion, upon a mast such as a metal mast 14, via an isolator assembly 16.

In the embodiment illustrated, isolator assembly 16 comprises a non-conductive tubular insulating form such as tube 18, as of fiberglass, on which is disposed a coil form 20. Coil form 20 is provided with a suitable winding or coil 22. Conductive end sleeves 24, 26 are provided at each end of the coil. At the upper end, a lug formed with end sleeve 24 is connected, as by soldering, to the coil 22. At the lower end, end sleeve 26 is connected to the other end of the coil 22 and to the outer or shield conductor 29 of a coaxial connector 30. The center conductor 31 of the connector 30 is connected to the coil 22 at a suitable tap point **22*a* to provide the desired impedance match, such as about 50 ohms. The entire isolator assembly is then encapsulated in a suitable encapsulant 36 of insulating material, such as a twenty percent glass filled polyethylene. It will be apparent that the two-piece coil form and tube may be formed of a single piece and that various suitable materials may be substituted for those and for the encapsulating medium which in the aggregate, as shown, entirely surrounds and encapsulates the coil 22 and sleeves 24, 26** by insulating material.

The radiator 12 is capacitively coupled to the coil 22 and to a conventional coaxial cable 32 through the connector 30. To this end, an inner conductive sleeve 34 internally of tube 18 is provided and confronts and is spaced away from radiator 12. The upper end of curved sleeve 34 and lower end or radiator 12 define a coupling capacitor (capacitor 50) through tube 18. The lower end of the sleeve 34 and upper end sleeve 24 confront each other and are spaced away from each other to define a further coupling capacitor 52. Capacitors 50, 52 transmit and conduct radiation between the antenna radiator and coaxial connector.

The capacitor coupling allows passage of radio frequency energy to be transmitted and received, but blocks or isolates D.C. and low frequency AC voltage as high as 50 kv. To complete the tuned circuit 53 and provide for fine tuning of the antenna assembly, a slidable tuner plate 40 is provided and is disposed in a channel 42 defined by the isolator assembly 16. Slidable tuner plate 40 defines a tuning capacitor 54 with upper and lower end sleeves 24, 26.

Figure 5:
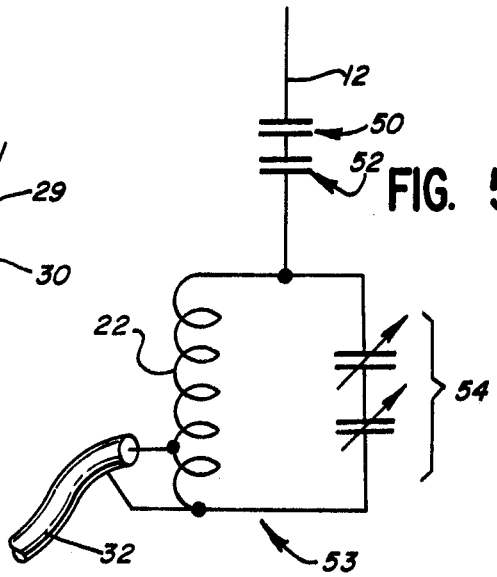
FIG. 5 is a schematic circuit diagram of the antenna assembly of FIG. 1.

As best seen in the circuit diagram, FIG. 5, the antenna radiator 12 is coupled capacitively through capacitors 50, 52 to the tuned circuit 53. Coil 22 is conventionally connected to the coaxial connector 30, hence to the coaxial cable 32.

It will be apparent that the isolator assembly serves to isolate the antenna rod from the mast and coaxial cable so that if, in erecting the mast and radiator, the antenna contacts power lines, the voltage imressed on the rod will not be transmitted to the mast. The gaps provided by the capacitive connection between the electrically connected radiator 12 and sleeve 34, on the one hand, and the sleeve 34 and the sleeves 24, 26, on the other hand, thereby electrically isolates the rod and mast against the transmission of high voltage therebetween within design parameters. In the embodiment illustrated, the breakdown voltage is about 50 kv, and therefore the isolator assembly 16 isolates the radiator from the mast and coaxial cable up to an impressed low frequency voltage of about 50 kv.

Despite warnings and many deaths resulting from the erection of CB antennas where carelessness has resulted in contacting power lines, death and injury recurs. The use of isolator assemblies in accordance with this invention has the potential for reducing the number of such injuries dramatically.

From the foregoing, it will be observed that numerous variations and modifications may be effected without departing from the true spirit and scope of the noval concept of the invention. It is, of course, intended to cover by the appended claims all such modifications as fall within the scope of the claims.

What is claimed is:

1. A transmitting and receiving communications antenna assembly for electrically isolating an antenna radiator from a mast and connector, comprising, an antenna member in the form of an elongate radiator adapted for mounting on a mast, an isolator assembly for electrically coupling said antenna member to a conductor, for mounting said antenna member on an electrically conductive mast and for electrically isolating said antenna member from said mast and connector, said isolator assembly comprising a radiator mount comprising a non-conductive gap defining means, capacitor plate means mounted adjacent said gap defining means in spaced relation to said antenna member to define a capacitor therewith, and tuning circuit means electrically connected to said capacitor plate means for connecting said capacitor plate means to said connector, said capacitor electrically coupling said antenna member to said tuning circuit means and isolating said connector and said mast from a high voltage on said antenna member and coupling radio frequency energy between said connector and said antenna member.

2. A transmitting and receiving antenna assembly in accordance with claim 1 wherein said isolator assembly further comprises a second capacitor plate means spaced from said first plate means by said gap defining means to define a second capacitor, said antenna member and said first capacitor plate means defining a first capacitor and said first capacitor plate means and said second capacitor plate means defining a second capacitor, said first and second capacitors coupling said antenna member to said tuning circuit means.

3. A transmitting and receiving antenna assembly in accordance with claim 2 wherein said isolator assembly includes said tuning circuit means.

4. A transmitting and receiving antenna assembly in accordance with claim 3 wherein said tuning circuit means comprises a coil connected to said second capacitor plate and to said connector, and circuit means for tuning said tuning circuit of said antenna assembly and for matching the impedance of said antenna assembly to the impedance of a load connected to said connector.

5. A transmitting and receiving antenna assembly in accordance with claim 4 wherein said tuning circuit means includes an adjustable tuning plate mounted on said isolator assembly and defining a third capacitor with said second capacitor plate means.

6. A transmitting and receiving communications antenna assembly comprising, an elongate generally tubular radiating antenna member adapted for mounting on a mast, an isolator assembly for coupling said antenna member to a transmission line connector and for electrically isolating said antenna member from the mast and from said connector while coupling radio frequency energy between said connector and said radiator, said isolator assembly comprising a tubular insulating form for receiving the base of said antenna member and the upper portion of the mast, first curved conductive plate means mounted on said tubular form and spaced away from said antenna member to define a first capacitor therewith, second capacitor plate means mounted on said tubular form and displaced from said antenna member and spaced away from said first curved plate member to define a second capacitor therewith, said first and second capacitors being connected to couple radio frequency energy to and from said antenna member, tuning circuit means, connector means, and means connecting said tuning circuit means to said second capacitor means and to said connector means for coupling radio frequency energy therebetween and for electrically isolating a high voltage on said antenna member from said connector and from the mast.

7. A transmitting and receiving antenna assembly in accordance with claim 6 wherein said tuning circuit means comprises coil means electrically connected to said second capacitor means.

8. A transmitting and receiving antenna assembly in accordance with claim 7 wherein said second capacitor means comprises a first sleeve member confronting said curved plate means and a second sleeve member axially spaced therefrom, each electrically connected to said coil means, and a tuning capacitor plate spaced from and confronting said first and second sleeve members to define tuning capacitor means.

* * * * *